United States Patent [19]

Pendleton et al.

[11] Patent Number: 4,810,156

[45] Date of Patent: Mar. 7, 1989

[54] BULK BAG UNLOADING STATION

[75] Inventors: Stevens P. Pendleton, Ramsey; Herbert A. Worsford, Wayne, both of N.J.

[73] Assignee: Vac-U-Max, Belleville, N.J.

[21] Appl. No.: 96,073

[22] Filed: Sep. 11, 1987

[51] Int. Cl.[4] ..... B65G 65/23

[52] U.S. Cl. ..... 414/415; 414/304; 222/203

[58] Field of Search ..... 414/304, 412, 414, 415, 414/403, 404, 467, 523, 527, 607, 608; 222/202, 203, 105, 196, 181, 185

[56] References Cited

U.S. PATENT DOCUMENTS

| | | | |
|---|---|---|---|
| 4,383,766 | 5/1983 | Eriksson | 222/203 X |
| 4,541,765 | 9/1985 | Moore | 414/304 X |
| 4,583,663 | 4/1986 | Bonerb | 414/304 X |
| 4,669,634 | 6/1987 | Leroux | 222/203 X |

FOREIGN PATENT DOCUMENTS

| | | | |
|---|---|---|---|
| 3231070 | 8/1984 | Fed. Rep. of Germany | 414/304 |
| 310855 | 10/1971 | U.S.S.R. | 222/203 |
| 1206188 | 1/1986 | U.S.S.R. | 414/415 |
| 1265097 | 10/1986 | U.S.S.R. | 222/203 |

*Primary Examiner*—Frank E. Werner

[57] ABSTRACT

A bulk bag unloading station having a frame from which a bag containing powdery, granular or fibrous material and having a bottom spout, may be suspended; a base plate with an opening; and a mechanism above the base plate for intermittently shaking a bottom portion of the bag to aid the flow of material from the spout. The mechanism has a number of liftable petals actuated pneumatically.

7 Claims, 2 Drawing Sheets

BULK BAG UNLOADING STATION

BACKGROUND OF THE INVENTION

The present invention relates to a bulk bag unloading station, and more particularly to means for assuring that bags are emptied in an efficient and safe manner.

A number of commodities, such as ingredients used in manufacturing, are packed and shipped in large semi-bulk bag containers. Once received at the manufacturing site the bag must be unloaded into storage or fed into the manufacturing process. Typically such bags are filled through the top and emptied out through the bottom of the bag. Such bags may have a bottom which is simply slit open to allow material to drop from it by gravity. The bag may also have a spout at the bottom that is first folded up inside the bottom and secured by a flap. Typically, an operator reaches in under the bag and unties or cuts a securing string, unfolds the spout, which might be 1 to 2 feet long so that the product could begin to flow out of the spout and into a container or pipeline or the like, underneath the spout. Many non-dusty and free-flowing products move readily out of these containers. However, there are other products, such as powders, powder granule mixtures, or fibrous materials which may not flow once the spout is opened by an operator. This is particularly true if the bags have been in transit for a long period of time, such as on a railroad car, truck or boat, or if a large number of such bags have been piled one on top of the other so that the material has been compressed. Finally, if the material in the bag is dusty and of a potentially toxic or environmentally harmful nature, there exists a dust control problem when the material starts to flow.

It is, therefore, an object of the present invention to provide an improved bulk bag unloading station which will overcome the above-mentioned problems in prior art unloading stations of this type.

BRIEF DESCRIPTION OF THE DRAWINGS

The invention will be explained by way of example, in connection with the accompanying drawings, in which.

DETAILED DESCRIPTION OF A PREFERRED EMBODIMENT

Figure 1:
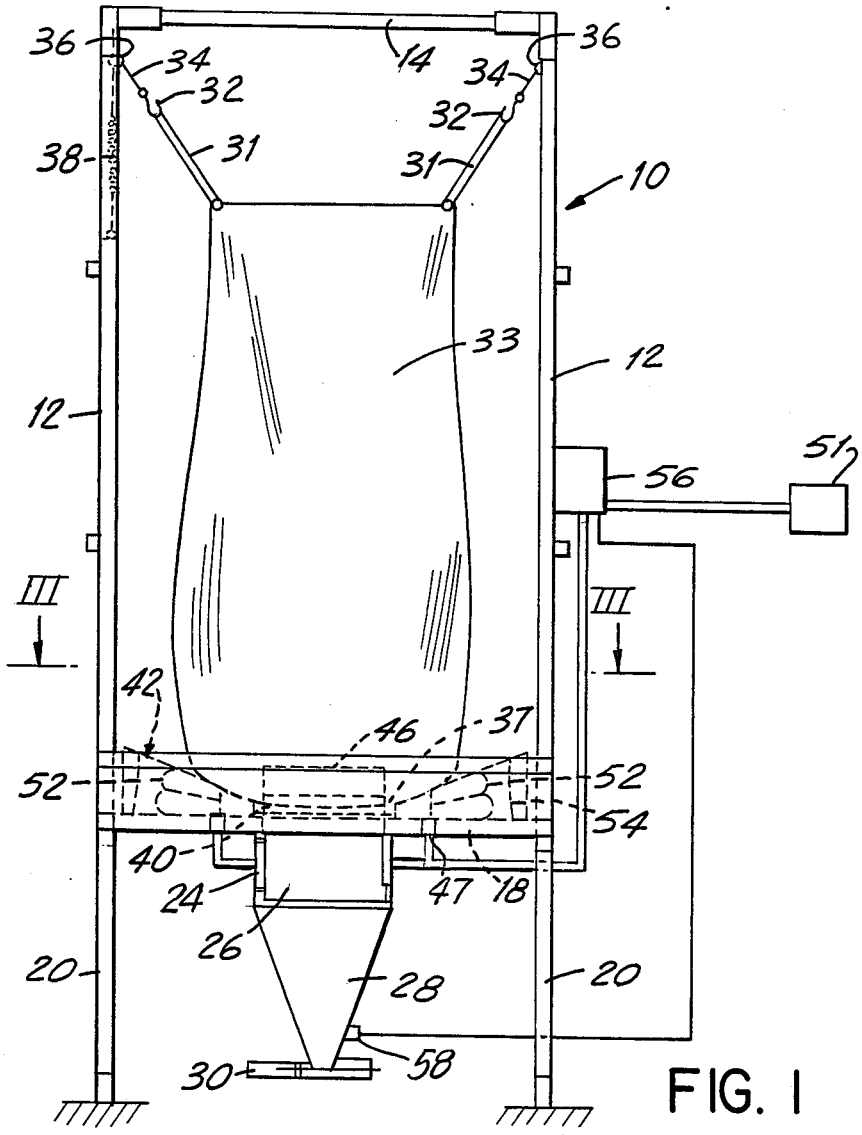
FIG. 1 is a front elevational view of a bulk bag unloading station according to the present invention.
Figure 2:
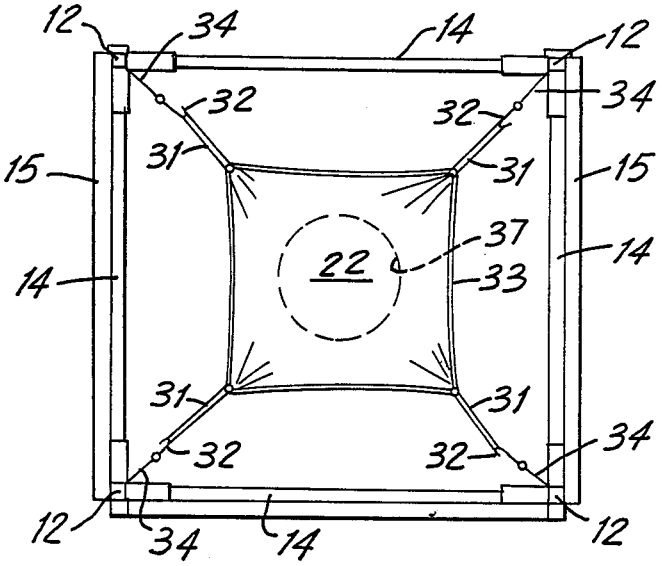
FIG. 2 is a top view of the bulk bag unloading station of FIG. 1.

Referring now to the drawings in detail, the bulk bag unloading station according to the present invention comprises a frame 10 having four vertical posts 12 arranged in a rectangle. There are also horizontal bars 14 at the top of the frame, side bars 15, and a base plate 18 at the bottom.

Below base plate 18 there may be a number of legs 20 for supporting the frame. The structure in the vicinity of the base plate 18 will be described further below. In the center of the base plate there is an opening 22 and below this opening an enclosed discharge adapter 24 which may have an access door 26. Below the discharge adapter there is a discharge shute 28 or the like leading to a pneumatic take-off conduit 30 or to any suitable type of conveyer.

Frame 10 is also provided with four hooks 32 arranged approximately at the corners of the frame, for connection to four top loops 31 on a bag 33 to be unloaded. Each hook 32 is connected to a cable 34 which runs over a pulley 36 and down to a long spring 38 connected to posts 12. The purpose of the hooks and the springs is to keep upward tension on the bag so that it is pulled upward as it empties, aiding emptying and preventing it from sagging down into the discharge underneath. The bag has a bottom flap or spout 37.

A bag to be emptied can be brought into position by a fork lift carrying the bag by top loops 31, or by a rail-mounted trolley overhead, or by other means.

Once the bag is deposited on the center of the table, an operator can work on the bottom opening of the bag from underneath the base plate in relative safety, as opposed to working on a bag which is suspended over the operator's head from loops 31.

The opening 22 in the base plate has a vertical collar 40 connected thereto which provides a good dust seal since it bites into the bottom of the bag.

Figure 3:
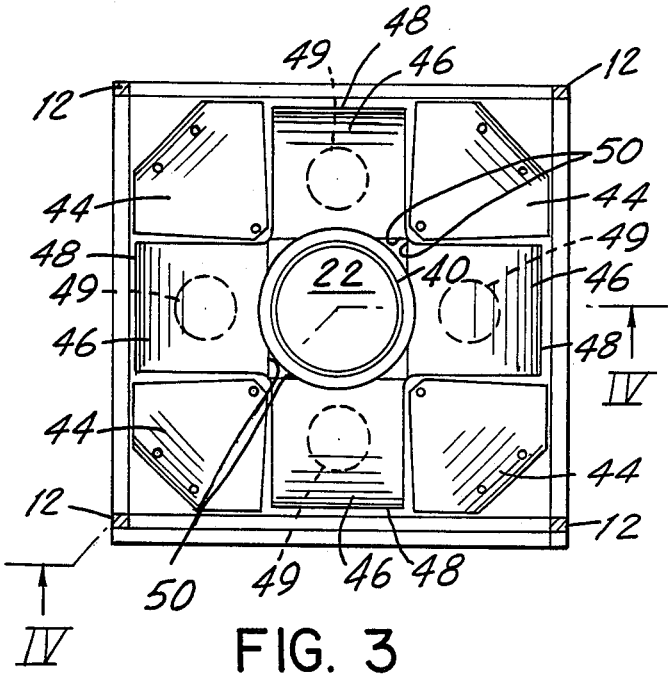
FIG. 3 is a partial horizontal section along line III—III of FIG. 1.
Figure 4:
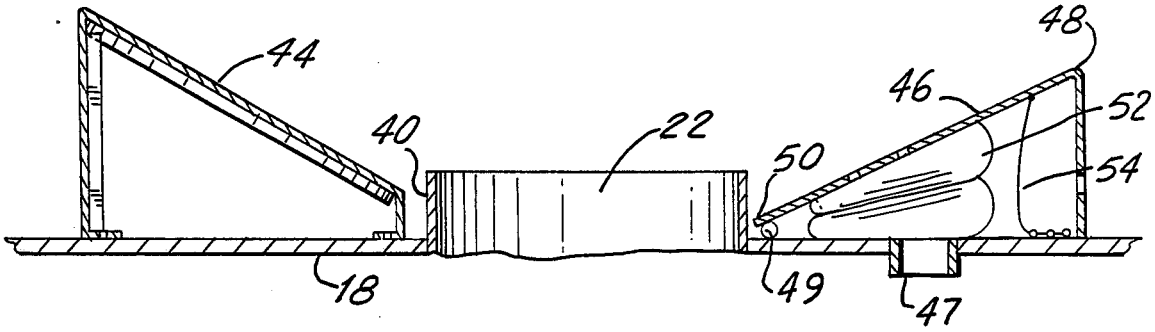
FIG. 4 is a vertical section through the lower portion of the bulk bag unloading station, along line IV-IV of FIG. 3.

Reference will now be made specifically to FIGS. 3 and 4 which show what might be called a massaging mechanism 42 which promotes the flow of even the most stubborn powder from bulk bag 33 into the discharge 24, 28, 30. Massaging mechanism 42 comprises eight petals arranged around the opening 22. Four petals 44 will fill the corners of the base plate and are stationary. The other four petals 46 in the center of each side of the base plate are movable. They may be raised up from their outer edge 48, pivoting up from base plate 18 around a shaft 49 at their respective front edge 50. Petals 46 move upward and inward as much as 8 or 9 inches, by means of an air stroke actuator 52 which is inflated between each petal 46 and the base plate 18 by compressed air from a source 51 through an inlet 47. A chain 54 at the back of each petal 46 and connected to the base plate restricts upward and inward motion of the respective petal. The air stroke actuator is very effective because there are no moving parts or shaft seals to be exposed to any dust or dirt.

The movement of petals 46 can be programmed by a control panel 56 such that two opposing petals can operate alternately, or all four petals can operate simultaneously or they can operate alternately around in a circular fashion. The petals thus raise and push the material into the center. The petals may be tied to a level control sensor 58 located in the discharge chute 28 beneath the bulk bag unloading station. The arrangement is such that the control panel 56 is allowed to operate only when the level control sensor 58 indicates that there is no material in the discharge adapter 24. This prevents the massager from operating in a continuous manner which is normally undesireable and unnecessary. An advantage of the massager and its controls, according to the present invention, is that they are operated pneumatically without electrical components on the bag unloading station itself.

We claim:

1. A bag unloading station comprising: a frame, means for suspending from said frame a bag containing a bulk material and having a bottom flap or spout; a base plate at a lower part of said frame and having an opening therein with a vertically extending axis; bulk material receiving means below said opening; and a mechanism above said base plate, for intermittently moving a bottom portion of the bag placed thereon, said mechanism including a plurality of petals, at least several of said petals being plates pivotable respectively about a substantially horizontal shaft adjacent said opening, and a plurality of pneumatically operable actuators between said base plate and said several petals respectively for pivoting said plates about their respective shafts away from said base plate toward said vertically extending axis and downwardly again back toward said base plate, to thereby shake-up the material in the bag and facilitate flow thereof through the bottom flap or spout when opened and through said opening into the bulk material receiving means.

2. A bag unloading station according to claim 1, wherein said suspending means includes a plurality of pulleys arranged at spaced locations at said frame, a plurality of hooks for engaging loops on the bag, and cable means connected to the hooks, passing over the pulleys, and fastenable to the frame, for suspending the bag at varying heights in said frame.

3. A bag unloading station according to claim 2, comprising tensioning means connected to said cable means for maintaining said loops and thereby the bag under tension.

4. A bag unloading station according to claim 1, wherein said mechanism comprises a first group of petals which are fixed and a second group consisting of said several petals which are liftable and lowerable by said actuators.

5. A bag unloading station according to claim 4, wherein said base plate is substantially square, the petals of the first group are arranged at the corners of the square, and the petals of the second group are arranged between the petals of the first group.

6. A bag unloading station according to claim 1, comprising means for operating said actuators in a timed sequence.

7. A bag unloading station according to claim 6, comprising means arranged in said receiving means for ascertaining the level of material therein, and for actuating said operating means upon said level ascertaining means determining too low a level of material in said receiving means.

* * * * *

US004810156B1

REEXAMINATION CERTIFICATE (3603rd)

United States Patent [19] [11] B1 4,810,156

Pendleton et al. [45] Certificate Issued Aug. 18, 1998

[54] BULK BAG UNLOADING STATION

[75] Inventors: Stevens P. Pendleton, Ramsey; Herbert A. Worsford, Wayne, both of N.J.

[73] Assignee: Vac-U-Max, Belleville, N.J.

Reexamination Request:
No. 90/004,595, Apr. 7, 1997

Reexamination Certificate for:

| | |
|---|---|
| Patent No.: | **4,810,156** |
| Issued: | **Mar. 7, 1989** |
| Appl. No.: | **96,073** |
| Filed: | **Sep. 11, 1987** |

[51] Int. Cl.[6] ..... B65G 65/23
[52] U.S. Cl. ..... 414/415; 414/304; 222/203
[58] Field of Search ..... 414/304, 412, 414/414, 415, 403, 404, 467, 523, 527, 607, 608; 222/202, 203, 105, 196, 180, 185, 103

[56] References Cited

U.S. PATENT DOCUMENTS

| | | | |
|---|---|---|---|
| 2,858,051 | 10/1958 | Cunningham . | |
| 4,383,766 | 5/1983 | Eriksson | 222/203 X |
| 4,541,765 | 9/1985 | Moore | 414/304 X |
| 4,583,663 | 4/1986 | Bonerb | 414/304 X |
| 4,669,634 | 6/1987 | Leroux | 222/203 X |

FOREIGN PATENT DOCUMENTS

| | | | |
|---|---|---|---|
| 3231070 | 8/1984 | Germany | 414/304 |
| 310855 | 10/1971 | U.S.S.R. | 222/203 |
| 1206188 | 1/1986 | U.S.S.R. | 414/415 |
| 1265097 | 10/1986 | U.S.S.R. | 222/203 |

*Primary Examiner*—Frank E. Werner

[57] ABSTRACT

A bulk bag unloading station having a frame from which a bag containing powdery, granular or fibrous material and having a bottom spout, may be suspended; a base plate with an opening; and a mechanism above the base plate for intermittently shaking a bottom portion of the bag to aid the flow of material from the spout. The mechanism has a number of liftable petals actuated pneumatically.

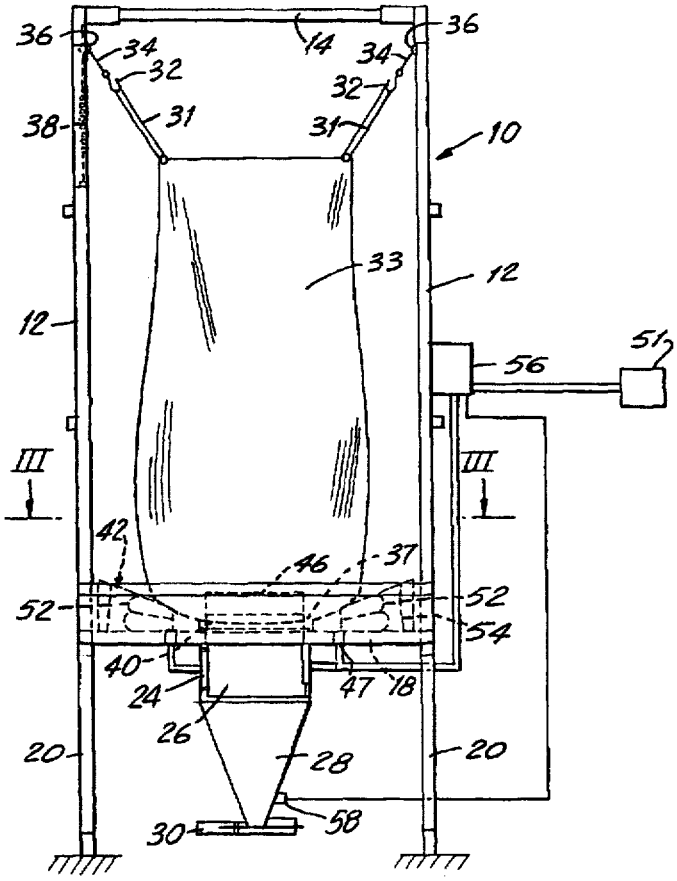

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 6 are cancelled.

Claims 2, 4 and 7 are determined to be patentable as amended.

Claims 3 and 5, dependent on an amended claim, are determined to be patentable.

2. *A bag unloading station comprising: a frame, means for suspending from said frame a bag containing a bulk material and having a bottom flap or spout; a base plate at a lower part of said frame and having an opening therein with a vertically extending axis; a bulk material receiving means below said opening; and a mechanism above said base plate, for intermittently moving a bottom portion of the bag placed thereon, said mechanism including a plurality of petals, at least several of said petals being plates pivotable respectively about a substantially horizontal shaft adjacent said opening, and a plurality of pneumatically operable actuators between said base plate and said several petals respectively for pivoting said plates about their respective shafts away from said base plate toward said vertically extending axis and downwardly again back toward said base plate, to thereby shake-up the material in the bag and facilitate flow thereof through the bottom flap of spout when opened and through said opening into the bulk material receiving means* [A bag unloading station according to claim 1], wherein said suspending means includes a plurality of pulleys arranged at spaced locations at said frame, a plurality of hooks for engaging loops on the bag, and cable means connected to the hooks, passing over the pulleys, and fastenable to the frame, for suspending the bag at varying heights in said frame.

4. *A bag unloading station comprising: a frame, means for suspending from said frame a bag containing a bulk material and having a bottom flap or spout; a base plate at a lower part of said frame and having an opening therein with a vertically extending axis; a bulk material receiving means below said opening; and a mechanism above said base plate, for intermittently moving a bottom portion of the bag placed thereon, said mechanism including a plurality of petals, at least several of said petals being plates pivotable respectively about a substantially horizontal shaft adjacent said opening, and a plurality a pneumatically operable actuators between said base plate and said several petals respectively for pivoting said plates about their respective shafts away from said base plate toward said vertically extending axis and downwardly again back toward said base plate, to thereby shake-up the material in the bag and facilitate flow thereof through the bottom flap of spout when opened and through said opening into the bulk material receiving means* [A bag unloading station according to claim 1], wherein said mechanism comprises a first group of petals which are fixed and a second group consisting of said several petals which are liftable and lowerable by said actuators.

7. *A bag unloading station comprising: a frame, means for suspending from said frame a bag containing a bulk material and having a bottom flap or spout; a base plate at a lower part of said frame and having an opening therein with a vertically extending axis; a bulk material receiving means below said opening; and a mechanism above said base plate, for intermittently moving a bottom portion of the bag placed thereon, said mechanism including a plurality of petals, at least several of said petals being plate pivotable respectively about a substantially horizontal shaft adjacent said opening, and a plurality of pneumatically operable actuators between said base plate and said several petals respectively for pivoting said plates about their respective shafts away from said base plate toward said vertically extending axis and downwardly again back toward said base plate, to thereby shake-up the material in the bag and facilitate flow thereof through the bottom flap of spout when opened and through said opening into the bulk material receiving means and comprising means for operating said actuators in a timed sequence* [A bad unloading station according to claim 6], comprising means arranged in said receiving means for ascertaining the level of material therein, and for actuating said operating means upon said level ascertaining means determining too low a level of material in said receiving means.

* * * * *